United States Patent [19]

Torii

[11] Patent Number: 4,820,069

[45] Date of Patent: Apr. 11, 1989

[54] SHEET-FEEDING APPARATUS WITH SELECTABLE UNIT FEED AND COEFFICIENT THEREFOR

[75] Inventor: Hiroshi Torii, Inazawa, Japan

[73] Assignee: Brother Kogyo Kabushiki Kaisha, Aichi, Japan

[21] Appl. No.: 60,154

[22] Filed: Jun. 10, 1987

[30] Foreign Application Priority Data

Jun. 16, 1986 [JP] Japan ..... 61-139689

[51] Int. Cl.[4] ..... B41J 19/92

[52] U.S. Cl. ..... 400/568; 400/555; 400/711; 400/549

[58] Field of Search ..... 400/545, 549, 555, 568, 400/569, 583, 583.4, 902, 703, 711

[56] References Cited

U.S. PATENT DOCUMENTS

| | | | |
|---|---|---|---|
| 3,643,039 | 2/1972 | Barcomb et al. | 400/902 |
| 3,644,812 | 2/1972 | Bitto et al. | 400/902 |
| 4,500,216 | 2/1985 | Demonte et al. | 400/12 |
| 4,558,965 | 12/1985 | Ueda et al. | 400/902 |
| 4,609,299 | 9/1986 | Hattori et al. | 400/229 |

FOREIGN PATENT DOCUMENTS

| | | | |
|---|---|---|---|
| 74185 | 5/1982 | Japan | 400/902 |

OTHER PUBLICATIONS

Centronics Model 351 Operator, Installation & Programming Instruction, Apr. 1984.

*Primary Examiner*—David A. Wiecking
*Attorney, Agent, or Firm*—Barnes & Thornburg

[57] ABSTRACT

The present invention relates to a printing apparatus such as a typewriter which prints data from an inputting means on a printing medium.

In the case of the normal printing apparatus, a feed amount setting means is installed which sets the amount of feed of line feeding or space feeding for relatively moving a printing head and the printing medium, and for the line feeding or for the space feeding, a desired one among about four kinds of amounts of feed is required to be selected.

This printing apparatus comprises a unit feed amount selecting means for selecting a unit amount of feed, a feed amount setting means which selects a coefficient to multiply the unit amount of feed selected by this unit feed amount selecting means and sets the actual amount of feed, and a controlling means controlling a feeding mechanism so that the amount of feed of the relative movement is the amount of feed set by the feed amount setting means. Lamps are lit to indicate the feed amount.

7 Claims, 7 Drawing Sheets

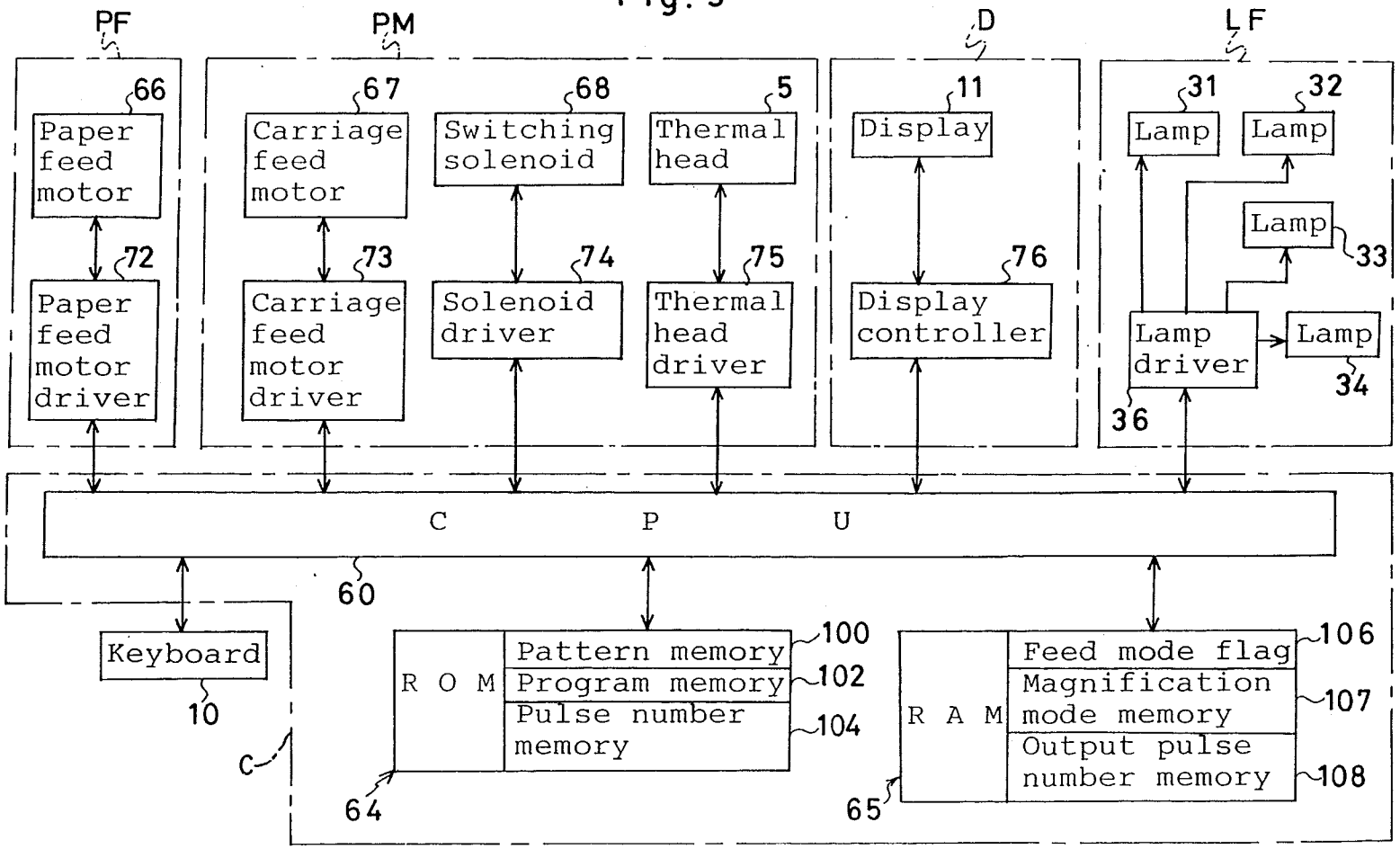
Fig. 3
LF
31
Lamp
32
Lamp
33
Lamp
34
Lamp
Lamp driver
36
D
11
Display
76
Display controller
PM
67
Carriage feed motor
73
Carriage feed motor driver
68
Switching solenoid
74
Solenoid driver
5
Thermal head
75
Thermal head driver
PF
66
Paper feed motor
72
Paper feed motor driver
C P U
60
Keyboard
10
C
R O M
64
Pattern memory
100
Program memory
102
Pulse number memory
104
R A M
65
Feed mode flag
106
Magnification mode memory
107
Output pulse number memory
108

SHEET-FEEDING APPARATUS WITH SELECTABLE UNIT FEED AND COEFFICIENT THEREFOR

BACKGROUND OF THE INVENTION

The present invention relates to a printing apparatus. More specifically, the present invention relates to a printing apparatus wherein a setting means and a controlling means of the amount of feed of a relative movement between a printing medium and a printing mechanism such as line feeding of the printing media and pitch feeding of a printing head.

Generally, in printing apparatuses such as electronic typewriters, when printing writings over a plurality of lines, a format of setting the right margin and the left margin, the amount of line feeding in changing the line and the like is determined before printing.

In the conventional electronic typewriter, the unit amount of line feeding of the paper is determined normally at 1/6 inch, and a configuration is made in a manner that four kinds of amounts of line feeding, 1, 1½, 2 or 3 times the unit amount of line feed can be set selectively by operating a line key.

Also, for the user requiring an amount of line feeding other than the 1/6 inch unit amount, an electronic typewriter of special specifications is provided wherein paper can be fed by a special unit amount, for example, ⅛ inch or 9/48 inch by changing the gear ratio by means of replacing an intermediate gear installed in a paper feeding mechanism.

In this type of electronic typewriter, when an amount of line feeding other than the 1/6 inch unit amount is required, the unit amount of feed can be changed to a special one by changing the gear ratio, but the general users cannot change the unit amount of feed freely as required, and the unit amount of line feeding is limited to 1/6 inch or 1.5, 2 or 3 times thereof, this being a problem remaining unsolved.

Therefore, the principal object of the present invention is to provide a printing apparatus wherein the amount of feed for moving relatively the printing media and the printing mechanism can be set by selecting any one from among a plurality of unit amounts of feed and by selecting any one from among coefficients to multiply the unit amount of feed.

SUMMARY OF THE INVENTION

The present invention relates to a printing apparatus comprising: an inputting means for inputting data of characters and symbols to be printed; a printing mechanism for printing data inputted by the inputting means on a printing medium; a feeding mechanism for relatively moving a printing head of the above-mentioned printing mechanism and the printing medium; a unit feed amount selecting means for selecting a unit amount of feed in the above-mentioned relative movement; a feed amount setting means for setting the actual amount of feed by selecting a coefficient to multiply the unit amount of feed selected by the unit feed amount selecting means; and a controlling means for controlling the feeding mechanism so that the amount of feed in the relative movement is the set amount of feed based on an output from the feed amount setting means.

In a printing apparatus in accordance with the present invention, data inputted from a key-board or an external equipment is printed on the printing medium and the printing medium and the printing mechanism are moved relatively.

Selection of the unit amount of feed in the above-mentioned relative movement is performed by the unit feed amount selecting means, and the coefficient to multiply the unit amount of feed selected by the selecting means is selected and the actual amount of feed is set by the feed amount setting means.

When the feed controlling means receives an output from the feed amount setting means, it controls the feeding mechanism so that the amount of feed in the relative movement is the set amount of feed.

In accordance with the printing apparatus of the present invention, as described above, in order to set the amount of feed for moving relatively the printing medium and the printing mechanism, the selecting means for selecting the unit amount of feed and the feed amount setting means for selecting the coefficient to multiply the selected unit amount of feed and setting the actual amount of feed are installed, and the feed controlling means for controlling the printing mechanism so that this set amount of feed is maintained are installed, and therefore the amount of feed is properly selected to be set from among various amounts of feed, and the printing medium and the printing mechanism can be moved relatively by that amount of feed, and thereby the general-purpose usability and the trade value of the printing apparatus are enhanced to a great extent. Also, since such various amounts of feed are set in a manner that a plurality of unit amounts of feed are multiplied respectively by a plurality of coefficients, the number of keys has only to be increased responding to an increase in the unit amounts of feed, and therefore the key-board can be prevented from becoming larger in size and increasing in cost.

BRIEF DESCRIPTION OF THE DRAWINGS

FIG. 2 through FIG. 6 show an embodiment in accordance with the present invention, FIG. 2 is a perspective view of an electronic typewriter, FIG. 3 is a block diagram of a control system of the typewriter, FIG. 4(*a*)–(*d*) are explanatory views for explaining respective modes of line feeding when the 1/6 inch unit amount of feed is selected, FIGS. 5(*a*)–(*d*) are explanatory views for explaining respective modes of line feeding when the Ψ inch unit amount of feed is selected, and FIGS. 6(*a*) and (*b*) are a flowchart of a routine of setting and controlling paper feeding.

DESCRIPTION OF THE PREFERRED EMBODIMENT

Hereinafter, description is made on an embodiment in the case where the present invention is applied to an electronic typewriter based on drawings.

Figure 1:
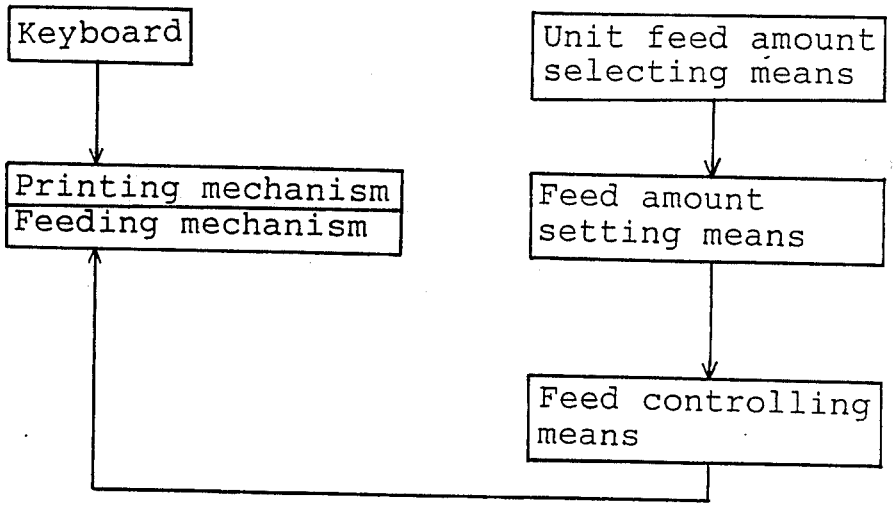
FIG. 1 is a functional block diagram of a printing apparatus in accordance with the present invention.
Figure 2:
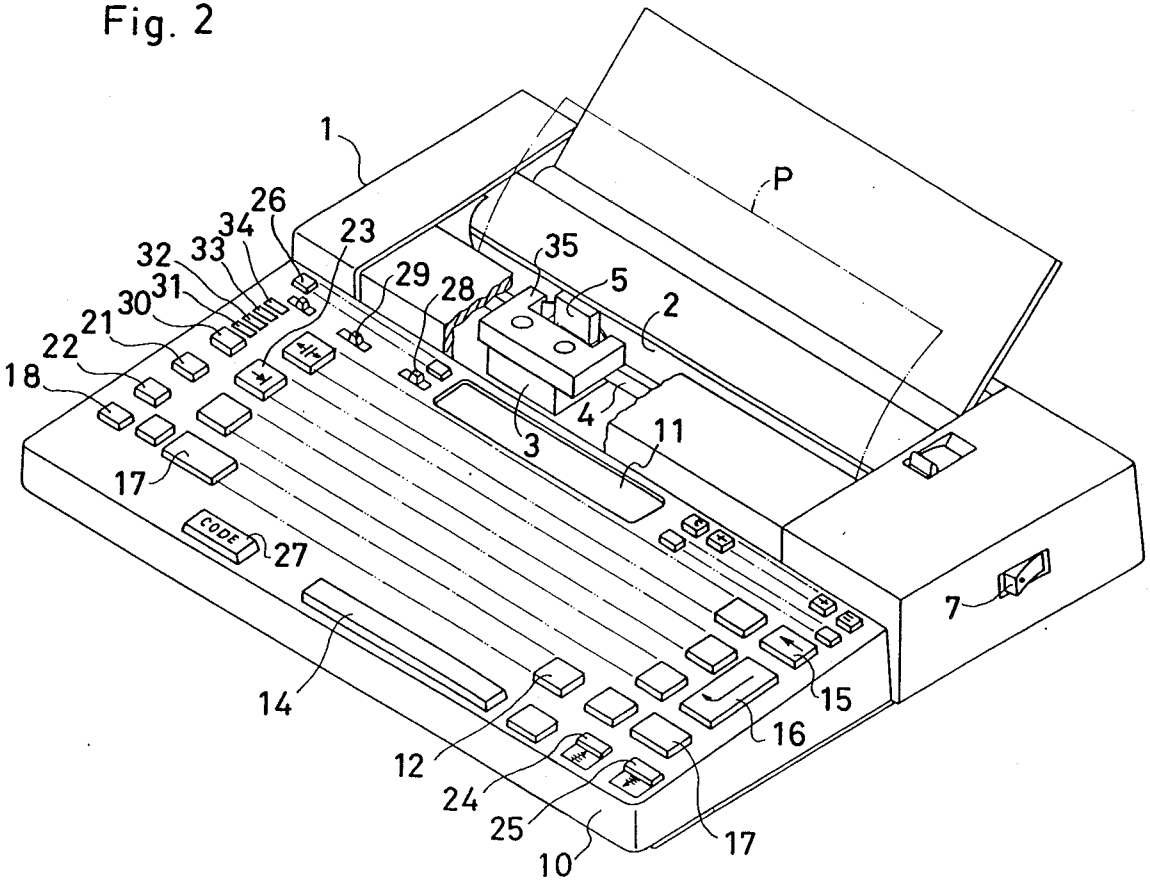

As shown in FIG. 2, a platen 2 is supported at the rear side part of a main unit case 1 of a typewriter, and in front thereof a guide rod 4 is disposed which extends parallel with the platen 2. A carriage 3 is supported so as to be movable right and left along the platen 2 on this guide rod 4. A thermal head 5 is attached to the carriage 3, and this thermal head 5 is position-changed between the printing position where this thermal head 5 is pressed against a print paper P in front of the platen 2 and the non-printing position where the head is parted from the print paper P.

A power switch 7 is installed on the side surface of the main unit case 1. Also, a keyboard 10 is installed at the front part of the main unit case 1, and a liquid crystal display (LCD) 11 of 15 digits shorter than one line is installed on the keyboard 10.

Furthermore, the following operating members such as various keys and change-over switches for operating the typewriter are disposed on the keyboard 10. Namely, the operating members include character symbol keys comprising alphabetic keys 12, numeric keys and a space key 14, a back space key 15, a carriage return key 16, a shift key 17, a second shift key 18, a tab set key 21, a tab clear key 22, a tab key 23, a paper feed back key 24, a paper feed key 25, a repeat key 26, a code key 27, a first and a second select switches 28 and 29, a line key 30 and the like.

The line key 30 is for setting by selectively switching over the 1-time mode that the amount of feed is one time the unit amount of feed (1/6 inch or ⅛ inch) specifically selected and set, the 1½ times mode that the amount of feed is one and a half times, the 2-times mode that the amount of feed is two times and the 3-times mode that the amount of feed is three times, and when the 1-time mode is selected a 1-time mode lamp 31 is lit, when the 1½ times mode is selected a 1½ times mode lamp 32 is lit, when the 2-times mode is selected a 2-times mode lamp 33 is lit, and when the 3-times mode is selected the 1-time mode lamp 31 and the 2-times mode lamp 33 are lit simultaneously.

Also, when the line key 30 and the code key 27 are operated simultaneously, the 1/6 inch or the ⅛ inch unit amount of line feed is selected alternately, and when the ⅛ inch unit amount of feed is selected, a lamp 34 is lit.

In addition, description on other keys is omitted because they are installed in the normal typewriter.

Also, detailed description on a carriage feeding mechanism which reciprocates the carriage 3 having the thermal head 5 right and left and a ribbon feeding mechanism incorporated in the carriage 3 are omitted because of the same configurations as those shown in the U.S. Pat. No. 4,609,299, and here a brief description is made on them.

When the thermal head 5 is moved in the printing direction at printing, a take-up spool rotates to take up a heat transfer ribbon on the take-up spool, but when the thermal head 5 is moved in the direction reverse to printing, the thermal head 5 retreats to the non-printing position, and thereby the take-up spool is prevented from rotating.

In addition, numeral 35 designates a ribbon cassette.

Next, description is made on the whole configuration of a control system of the above-mentioned electronic typewriter 1 in reference to a block diagram in FIG. 3.

A driving means PF for the paper feeding mechanism is provided with a paper feed motor 66, a paper feed motor driver 72 and the like, and a driving means PM for the printing mechanism is constituted with a carriage feed motor 67 moving the carriage 3, a carriage feed motor driver 73, a switching solenoid 68 switching selectively between the printing position and the non-printing position, a solenoid driver 74, the thermal head 5, a thermal head driver 75 and the like.

A displaying mechanism D is provided with the display (liquid crystal display) 11 and a display controller 76.

A line feed mode displaying mechanism LF is provided with the 1-time mode lamp 31 displaying the 1-time mode, the 1½ times mode lamp 32 displaying the 1½ times mode, the 2-times mode lamp 33 displaying the 2-times mode, the lamp 34 which is lit when the special ⅛ inch unit amount of line feeding is selected, a lamp driver 36 and the like.

A controlling apparatus C is provided with a CPU (central processing unit) 60, and a ROM (read only memory) 64 and a RAM (random access memory) 65 which are connected to the CPU 60. And, the keyboard 10, the respective drivers 72–75 of the driving means, the display controller 76 and the lamp driver 36 are connected to the CPU 60.

The ROM 64 comprises a pattern memory 100 storing pattern data such as various characters and symbols, a program memory 102 storing controlling programs controlling the driving means PF of the paper feeding mechanism, the driving means PM of the printing mechanism, the displaying mechanism D and the line feed mode displaying mechanism LF and a paper feed controlling program for controlling paper feeding as described later and the like, and a pulse number memory 104.

The pulse number memory 104 stores in advance a table of the 1/6 inch unit amount of feed storing the numbers of pulses which drive the paper feed motor 66 corresponding to the respective amounts of line feeding of 1, 1½, 2 and 3 times when the normal 1/6 inch unit amount of line feeding is selected and a table of the ⅛ inch unit amount of feed storing the numbers of pulses which drive the paper feed motor 66 corresponding to the respective amounts of line feeding of 1, 1½, 2 and 3 times when the special ⅛ inch unit amount of feeding paper is selected.

The RAM 65 comprises a present position memory storing at least the present position of the thermal head 5 corresponding to the printing position where printing is made on the print paper P, an input data memory storing in sequence code data inputted through the keyboard 10 corresponding to the printing position, a feed mode flag 106 which is set when the special 1/8 inch unit amount of line feeding is selected, a magnification mode memory 107 storing a renewed mode every time the selected and set magnification mode (1-time mode, 1½-times mode, 2-times mode or 3-times mode) is changed, an output pulse number memory 108 storing the number of pulses in the table of the pulse number memory 104 corresponding to the selected magnification mode and feed mode every time a magnification mode and a feed mode are selected and set, various temporary memories required for controlling the paper feeding mechanism, the printing mechanism and the displaying mechanism D, and the like.

The CPU 60 stores in sequence the code data corresponding to characters and symbols such as alphabet, numerals, space, operators and other symbols which are inputted through the character symbol keys of the keyboard 10 in the input data memory of the RAM 65, and reads in sequence the pattern data corresponding to those code data from the pattern memory 100 of the ROM 64, outputting them to the display controller 76, the thermal head driver 75 of the printing mechanism PM and the carriage feed motor driver 73.

Furthermore, the CPU 60 processes the code data inputted through various function keys of the keyboard 10 by the controlling program read from the program memory 102 of the ROM 64, thereby outputting the control signal corresponding to the inputted code data to the paper feed motor driver 72 of the paper feeding mechanism PF, the carriage feed motor driver 73 and the solenoid driver 74 of the printing mechanism PM, and the display controller 76.

Then, the present embodiment is characterized by setting and controlling of paper feeding that the unit amount of line D feeding of normal 1/6 inch or special ⅛ inch is selected and set in order that the print paper P is fed by operating the line feed key such as the carriage return key 16 or by automatic line change. To easily understand the explanation of a flowchart, description is made on the outline of this setting and control of paper feeding.

Figure 4:
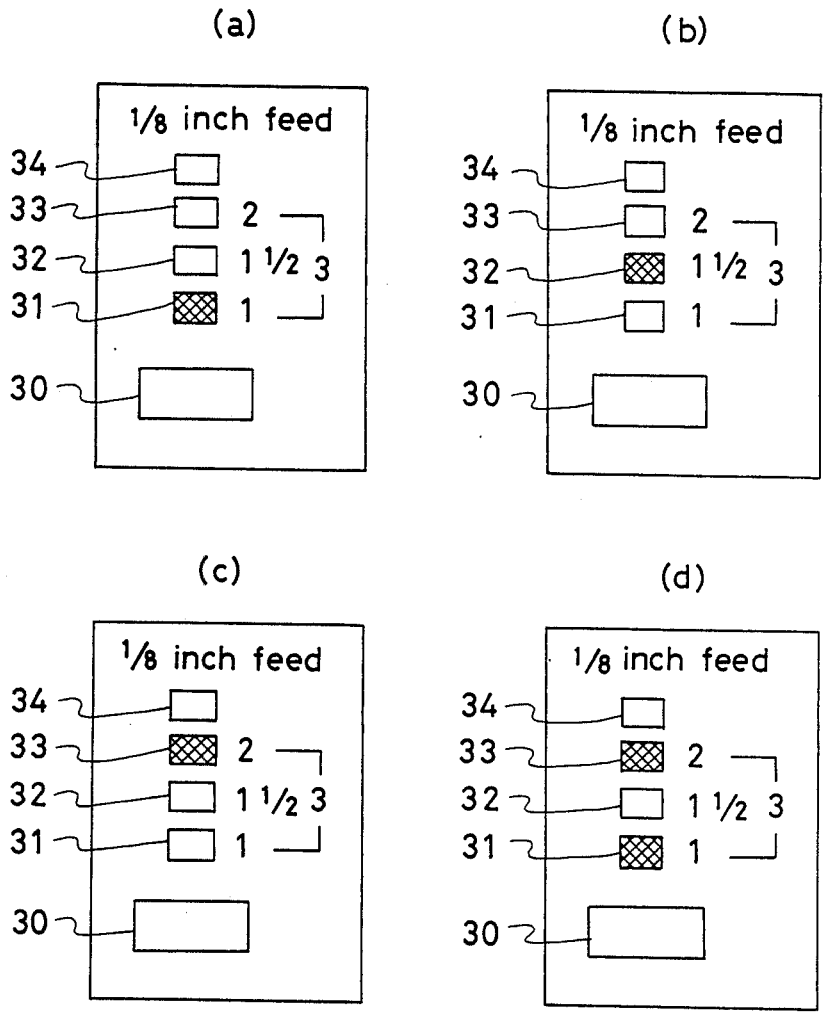

FIG. 4(*a*)–(*d*) show respective magnification modes; the 1-time mode, the 1½-time mode, the 2-times mode and the 3-times mode when the normal 1/6 inch unit amount of line feeding is selected. When the 1-time mode is selected by operating the line key 30 the 1-time mode lamp 31 is lit as shown in FIG. 4(*a*), when the 1½-times mode is selected the 1½ times mode lamp 32 is lit as shown in FIG. 4(*b*), when the 2-times mode is selected the 2-times mode lamp 33 is lit as shown in FIG. 4(*c*), and when the 3-times mode is selected the 1-time mode lamp 31 and the 2-times mode lamp 33 are lit as shown in FIG. 4(*d*).

Thereafter, the magnification mode is selected and set in the sequence of the 1-time mode (the lamp 31 is lit) → the 1½-times mode (the lamp 32 is lit) the 2-times mode (the lamp 33 is lit) the 3-times mode (the lamps 31 and 33 are lit) the 1-time mode every time the line key 30 is depressed, and the number of pulses in the table of the 1/6 inch unit amount of feed of the pulse number memory 104 corresponding to the selected magnification mode is written to the input pulse number memory 108.

Figure 5:
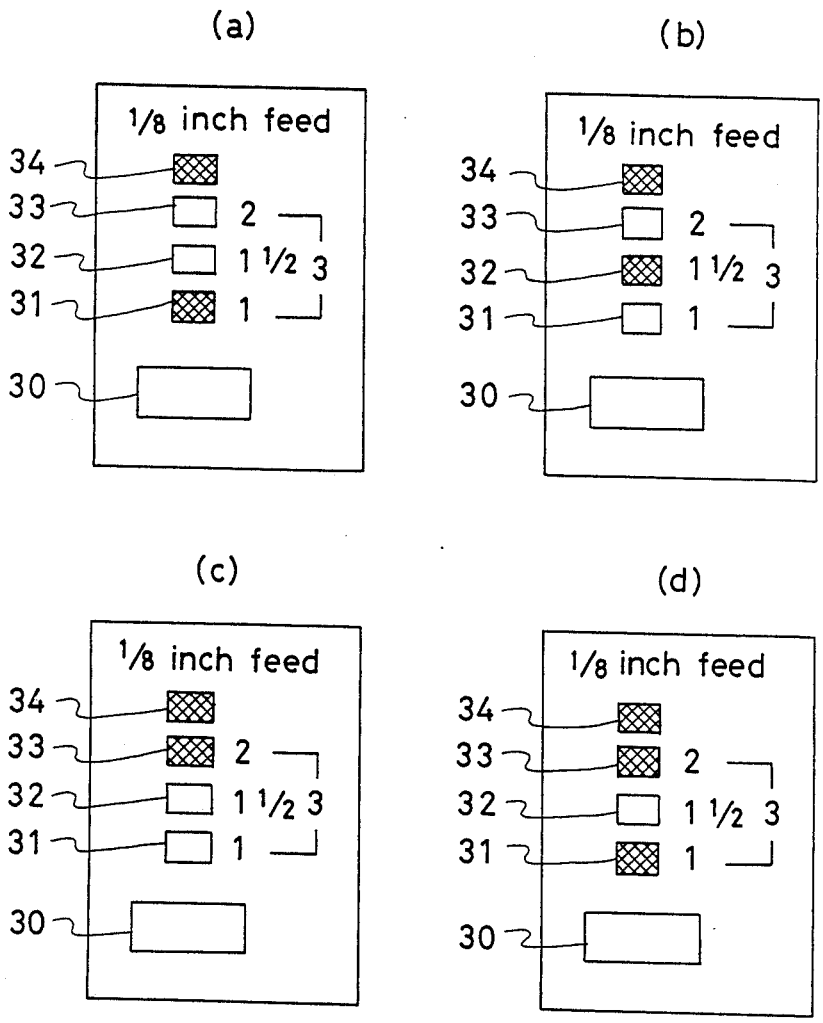

Next, when the line key 30 and the code key 27 are operated simultaneously, the feed mode is switched over, and as shown in FIG. 5(*a*)–(*d*), the special ⅛ inch unit amount of line feeding is selected, and the lamp 34 indicating ⅛ inch is lit.

Then, the magnification mode is selected and set in the sequence of the 1-time mode (the lamp 31 is lit) as shown in FIG. 5(*a*) → the 1½-times mode (the lamp 32 is lit) as shown in FIG. 5(*b*) →the 2-times mode (the lamp 3 is lit) as shown in FIG. 5(*c*) →the 3-times mode (the lamps 31 and 33 are lit) as shown in FIG. 5(*d*) →the 1-time mode likewise the case with the 1/6 inch unit amount of line feeding every time the line key 30 is depressed, and the number of pulses in the table of the ⅛ inch unit amount of feed of the pulse number memory 104 corresponding to the selected magnification mode is written to the output pulse number memory 108.

The magnification mode selected as mentioned above is stored in the magnification made memory 107.

The feed mode flag 106, the magnification mode memory 107 and the output pulse number memory 108 of the RAM 65 are supplied respectively by a battery back-up system, and store and hold the respective data immediately before the power switch 7 of the typewriter is turned off.

In addition, when the line key 30 and the code key 27 are operated simultaneously again, as shown in FIG. 4(*a*)–(*d*), the 1/6 inch unit amount of feeding paper is selected, and the lamp 34 is put out.

Figure 6:
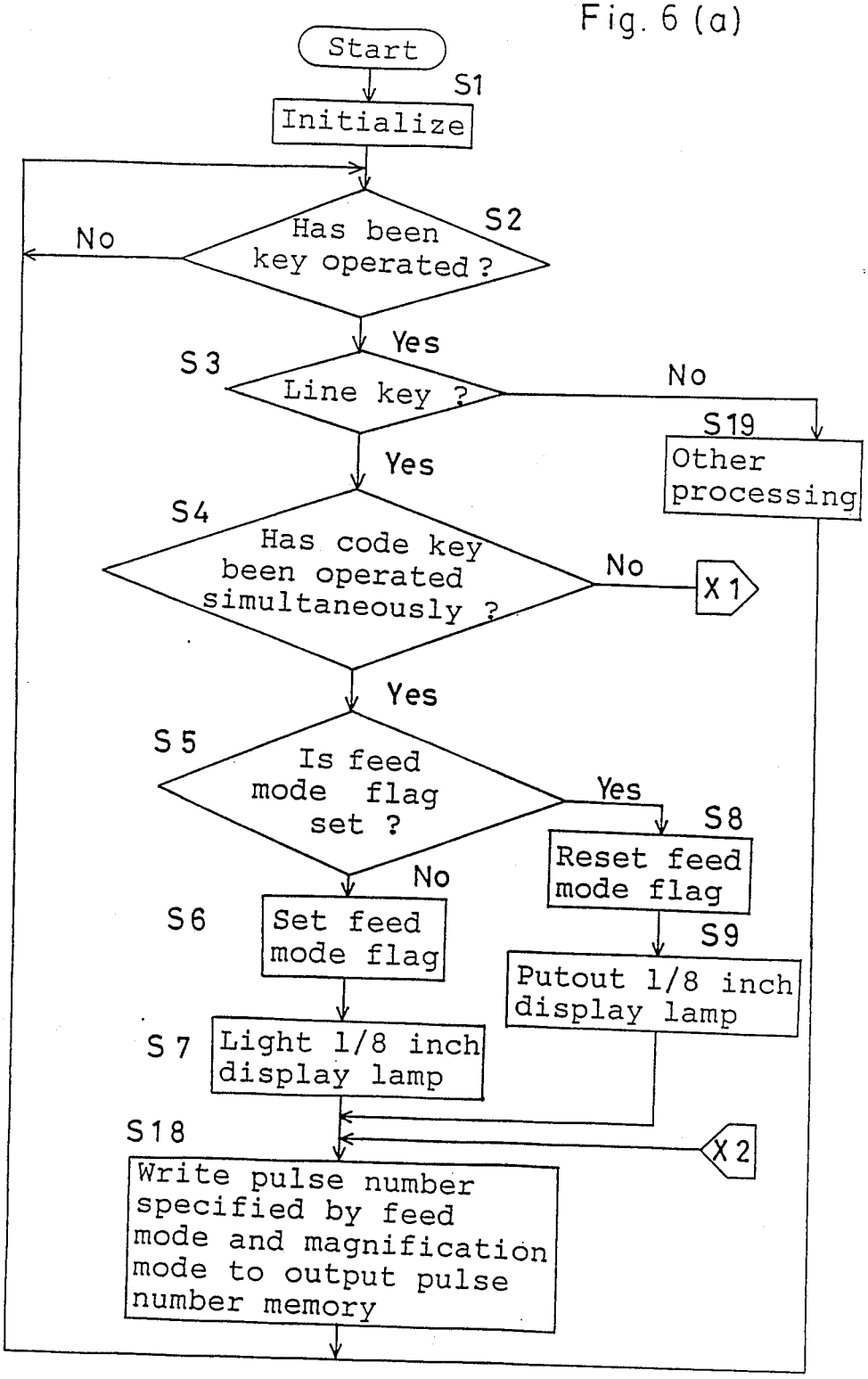
Figure 6B:
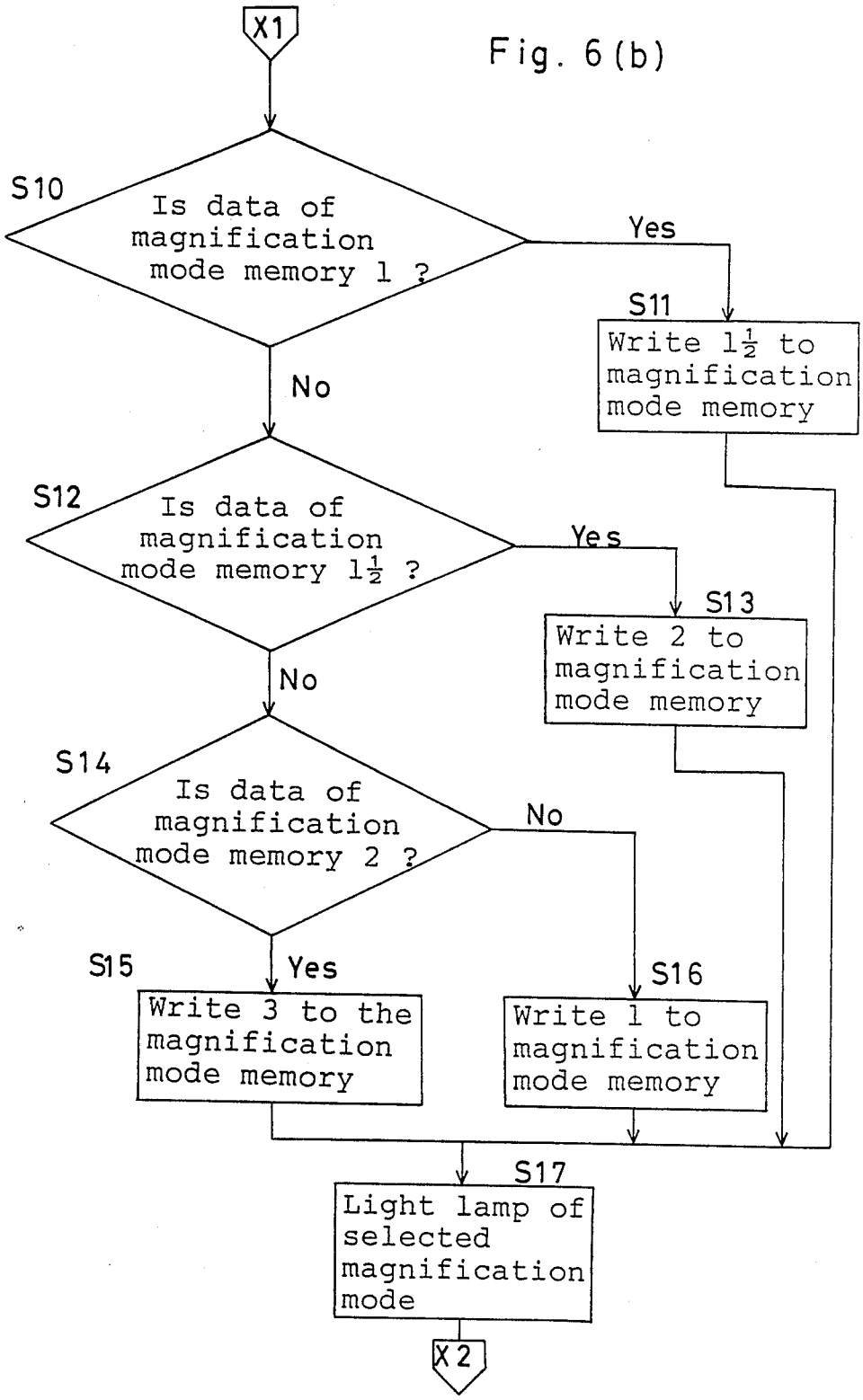

Next, description is made on the paper feed control performed by the controlling apparatus C of the electronic typewriter 1 based on a flow chart in FIGS. 6(*a*) and 6(*b*).

When the power switch of the typewriter is turned on, this control is started, and processing proceeds to step S1 (hereinafter, represented simply by S1 and the same is true also of other steps:), and initialization is executed, and processing proceeds to S2.

In S2, decision is made on whether or not a key-input has been performed (whether or not a key has been operated), and when no key has been operated, S2 is repeated every minute time until the key is operated, and when the key is operated, processing proceeds to S3.

In S3, decision is made on whether or not the operated key is the line key 30, and when the key is not the line key 30, processing proceeds to S19, and printing of the character or symbol corresponding to the operated character symbol key or processing corresponding to the operated function key is executed, and processing proceeds to S2 from S19.

In S4, decision is made on whether or not the code key 27 has been operated also simultaneously, that is, decision is made on whether the unit amount of line feeding has been switched to 1/6 inch or ⅛ inch, and when the code key 27 has been operated also simultaneously, processing proceeds to S5, and when the code key has not been operated simultaneously, processing proceeds to S10.

In S5, decision is made on whether or not the feed mode flag 106 of the RAM 65 is set, that is, whether or not the special ⅛ inch feed mode is selected, and when not set (when the 1/6 inch feed mode is selected), processing proceeds to S6, and when the flag 106 is set, processing proceeds to S8.

The following S6–S7 are steps of selecting and setting the feed mode of ⅛ inch unit amount of line feeding, and in S6, the feed mode flag 106 is set and the feed mode of ⅛ inch is selected. D In the next S7, the ⅛ inch display lamp 34 on the key-board 10 is lit based on the feed mode flag 106, and processing proceeds to S18 from S7.

S8–S9 are steps of selecting and setting the feed mode of 1/6 inch unit amount of line feeding, and in S8, the feed mode flag 106 is reset and the feed mode of 1/6 inch is selected. In the following S9, the ⅛ inch display lamp 34 on the key-board 10 is put out based on the feed mode flag 106, and processing proceeds to S18 from S9.

On the other hand, when only the line key 30 is operated, processing proceeds to S10 through S2–S4.

The following S10–S11 are steps of selecting the 1½-times mode of line feeding, and in S10, decision is made on whether or not data of the magnification mode memory 107 is "1" (the 1-time mode), and when the data is "1", processing proceeds to S11, and when the data is not "1", processing proceeds to S12.

In S11, "1½" is written to the magnification mode memory 107, and the 1½-times mode is selected, and processing proceeds to S17 from S11.

The next S12–S13 are steps of selecting the 2-times mode of line feeding, and in S12, decision is made on whether or not data of the magnification mode memory 107 is "1½" (the 1½-times mode), and when the data is "1½", processing proceeds to S13, and when the data is not "1½", processing proceeds to S14.

In S13, "2" is written to the magnification mode memory 107, and the 2-times mode is selected, and processing proceeds to S17 from S13.

The following S14–S15 are steps of selecting the 3-times mode of line feeding, and in S14, decision is made on whether or not data of the magnification mode memory 107 is "2" (the 2-times mode), and when the data is "2", processing proceeds to S15, and when the data is not "2", that is, when the data is "3" (the 3-times mode), processing proceeds to S16, and "1" is written to the magnification mode memory 107, and the 1-time mode is selected and processing proceeds to S17 from S16.

In S15, "3" is written to the magnification mode memory 107, and the 3-times mode is selected and processing proceeds to S17 from S15.

In S17, the lamps 31–33 corresponding to the respective magnification mode presently selected are lit.

In the above-mentioned case, the CPU 60 outputs a control signal to the lamp driver 36.

Next, in S18, the selected number of pulses of the pulse number memory 104 is written to the output pulse number memory 108 of the RAM 65 based on the data of the magnification mode of the magnification mode memory 107 and the feed mode flag 106, and processing proceeds to S2 from S18.

Then, when the carriage return key 16 is operated, the CPU 60 outputs the control signal corresponding to the number of pulses stored in the output pulse number memory 108 to the paper feed motor driver 72 based on the control program of the program memory 102, and thereby the paper feed motor 66 is rotated, and the print paper P is fed by the amount corresponding to the presently selected feed mode and magnification mode.

In addition, when the feed motor 66 is constituted with a DC motor in place of a step motor, a constitution may be made in a manner that the detected number of pulses from an encoder installed in the DC motor is fed back, and the number of pulses corresponding to the amount of feed determined by the feed mode and the magnification mode is stored in the pulse number memory 104, and the rotation-driving of the DC motor is controlled.

As described above, since two kinds of 1/6 inch and ⅛ inch are incorporated as the unit amounts of line feeding, a desired unit amount of line feeding can be selected as required.

Also, to display the 3-times mode, the 1-time mode lamp 31 and the 2-times mode lamp 33 are lit, and the lamp used conventionally as a display lamp for the 3-times mode is used for displaying the ⅛ inch unit amount of line feeding, and therefore no new display lamp is required to be added.

In addition, in the above-mentioned embodiment, description is made on the case with two kinds of unit amounts of line feeding, 1/6 inch and ⅛ inch, but a configuration capable of setting three or more kinds of unit amounts of feed by a control system similar to the above-mentioned embodiment can be made. The same is true of the magnification mode, and the magnification modes of 1, 1½, 2 and 3 times are shown merely as examples, and the magnification mode may be set properly, and an increase or a change in the kinds of magnification modes can be realized by a control system similar to the above-mentioned embodiment.

In addition, the above-mentioned embodiment is of the case where the present invention is applied to the setting and controlling of line feeding of paper, and the present invention is applicable likewise also to setting and controlling of the carriage feeding which moves a carriage carrying a printing head, a printing hammer or the like in a manner relative to the print paper.

In addition, in the above-mentioned embodiment, description is made on the typewriter providing the thermal printer, but it is needless to say that the present invention is applicable likewise also to other printing apparatuses such as a typewriter or a word processor having a daisy-wheel type printer or a type-ball type printer.

What is claimed is:

1. A print apparatus comprising:

inputting mean for inputting data of characters and symbols to be printed, a printing mechanism for printing data inputted by said inputting mean on a printing medium, a feeding mechanism for relatively moving a printing head of said printing mechanism and said printing medium, unit feed amount selecting means for selecting a unit amount of feed of said relative movement, feed amount setting means for selecting coefficient to multiply said unit amount of feed selected by said unit feed amount selecting means and for setting an actual amount of feed, and said feed amount setting means including a coefficient select key for selecting said coefficient and displaying means for displaying said selected unit amount of feed and said selected coefficient to multiply said selected unit amount of feed, said displaying means having a number of display lamps less than the total number of coefficients, and said display means displays some of the coefficients by lighting plural display lamps simultaneously and some of the coefficients by lighting only one display lamp at a time in accordance with said coefficient selected by said coefficient select key, and controlling means for controlling said feed mechanism so that the amount of feed of said relative movement is said set actual amount of feed based on an output from said feed amount setting means.

2. A printing apparatus according to claim 1, wherein said unit feed amount selecting means includes said coefficient select key and another key which are operated simultaneously in order to select one in a cyclic fashion among plural unit amounts of feed.

3. A printing apparatus according to claim 1, wherein said coefficient to multiply said unit amount of feed is switched every depressing of said coefficient select key.

4. A printing apparatus according to claim 3, wherein said displaying means includes one or more unit amount display lamps to be lit selectively in accordance with said selected unit amount of feed, and the number of said unit amount display lamp are less than total number of said unit amounts of feed.

5. A printing apparatus according to claim 4, wherein said unit feed amount selecting means switches said unit amount of feed in a cyclic fashion every depressing of a predetermined key.

6. A printing apparatus according to claim 5, wherein said unit feed amount selecting means selects one of two unit amounts of feed, and the number of said unit amount display lamp is one, and said displaying means lights said unit amount display lamp only when specific one of two unit amounts of feed is selected.

7. A printing apparatus according to claim 6, wherein said two unit amounts of feed are 1/6 inch unit amount of feed and ⅛ inch unit amount of feed, and said specific unit amount of feed is ⅛ inch unit amount of feed, and said display lamps for displaying selected said coefficient are 1-time mode lamp, a 1½-times mode lamp and a 2-times mode lamp, and said 1-time mode lamp and said 2-times mode lamp are lit simultaneously when said coefficient of 3-times is selected.

* * * * *